US006431547B1

(12) United States Patent
Arkoosh et al.

(10) Patent No.: US 6,431,547 B1
(45) Date of Patent: Aug. 13, 2002

(54) GAME USING PLAYING PIECES

(76) Inventors: Rachel M. Arkoosh, 468 Jefferson St., Twin Falls, ID (US) 83301; John C. Arkoosh, 9163 Covey Hill Ct., Boise, ID (US) 83709; Julie Ann Nance, 818 Four Mile Rd.; William W. Boyer, 305 Ochsner Ave., both of Gooding, ID (US) 83330

( * ) Notice: Subject to any disclaimer, the term of this patent is extended or adjusted under 35 U.S.C. 154(b) by 0 days.

(21) Appl. No.: 09/603,871

(22) Filed: Jun. 26, 2000

(51) Int. Cl.[7] ..... A63F 3/00
(52) U.S. Cl. ..... 273/275; 273/264; 273/288
(58) Field of Search ..... 273/236, 264, 273/267, 271, 275, 288, 251

(56) References Cited

U.S. PATENT DOCUMENTS 2,571,195 A 10/1951 Buck
3,638,947 A * 2/1972 Hardesty
3,674,274 A * 7/1972 Schur
3,977,681 A 8/1976 Deitrich
4,221,387 A 9/1980 Carter
4,357,018 A 11/1982 Calvert
4,407,719 A 10/1983 Sajkovic

* cited by examiner

*Primary Examiner*—Benjamin H. Layno
*Assistant Examiner*—Vishu K Mendiratta
(74) *Attorney, Agent, or Firm*—Robert L. Shaver; Frank J. Dykas; Stephen M. Nipper

(57) ABSTRACT

A game, and method of playing a game, using colored polygonal game pieces on a flat surface. The game pieces are divided into playing pieces and scoring pieces, and the object of the game is to surround a scoring piece with a ring of playing pieces, or to score points by partially surrounding a scoring piece. The playing and scoring pieces are in colored groups, and the color of the playing piece must match the color of the scoring piece.

20 Claims, 4 Drawing Sheets

GAME USING PLAYING PIECES

BACKGROUND OF THE INVENTION

1. Field of the Invention

The present invention generally relates to games, and more particularly to games including playing pieces played on a playing surface.

2. Background Information

Many traditional games involve the placement and movement of pieces upon a surface, board or grid. Examples of such games include checkers, chess, Go, Chinese checkers, dominoes and the inventions shown in U.S. Pat. Nos. 4,357,018, 4,221,387, 4,047,719, 3,997,681, 3,677,549, and 2,571,195.

SUMMARY OF THE INVENTION

The preferred embodiment of the present invention is a game for use by two or more players. This game uses a plurality of flat, colored polygonal playing pieces having edges, the color of these playing pieces selected from a set of at least three colors. The game also has a plurality of flat polygonal scoring pieces having edges, the colors of the scoring pieces being selected from a set of at least three colors as well. These playing pieces are played upon a flat playing surface. The game is played by the players alternately placing either one of the polygonal playing pieces or one of the polygonal scoring pieces on the flat playing surface. The game pieces are played edge to edge. The object of the game is to surround or partially surround the scoring pieces with playing pieces of the same colors contained in the scoring piece. Points are awarded for runs of playing pieces adjacent to a scoring piece in which the playing pieces are of the colors contained in the scoring piece and adjacent playing pieces are in a run of alternating colors. Additionally, scoring pieces may be placed upon the top of playing pieces to add further complexities to the game.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
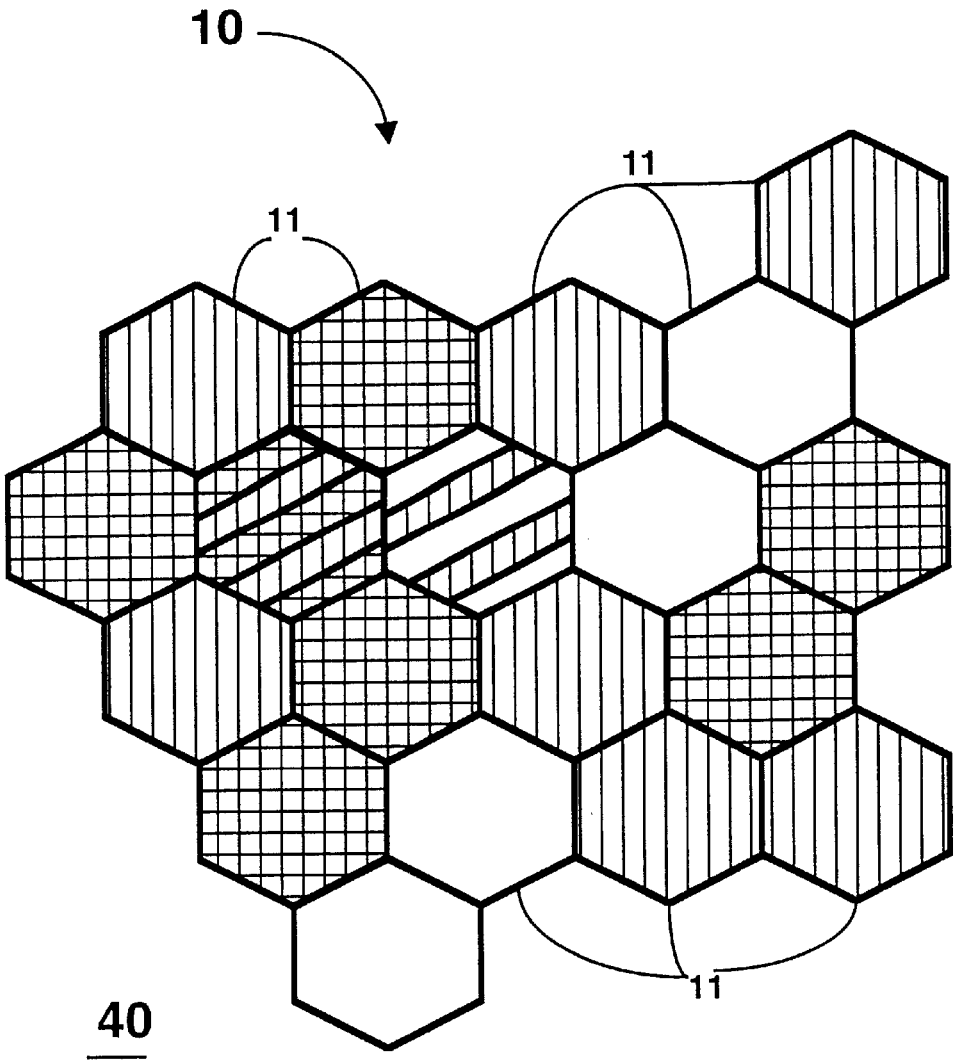
FIG. 1 is a plan view of the game apparatus showing a number of different playing and scoring pieces played.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The game illustrated in the drawings comprises a game apparatus 10 played upon a flat playing surface 40. The game apparatus further comprises various polygonal game pieces 11. These game pieces may be connected in a side to side abutment to form a straight row or "run." These game pieces 11 further comprise playing pieces and scoring pieces. The object of the game is to surround a scoring piece with game pieces in a particular order.

Figure 2A:
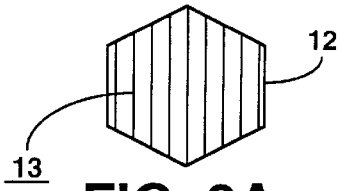
FIG. 2A is an obverse side view of the first color playing piece.
Figure 3A:
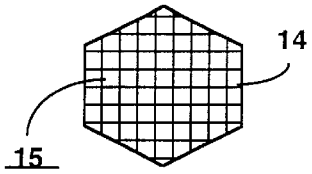
FIG. 3A is an obverse side view of the second color playing piece.
Figure 4A:
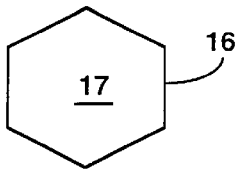
FIG. 4A is an obverse side view of the third color playing piece.
Figure 2B:
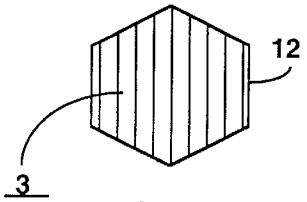
FIG. 2B is a reverse view of the first color playing piece.
Figure 3B:
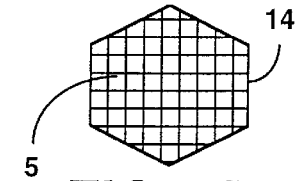
FIG. 3B is a reverse view of the second color playing piece.
Figure 4B:
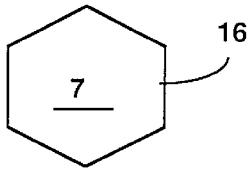
FIG. 4B is a reverse view of the third color playing piece.

The game is played at least two people or at least two teams of people. The game is played by individual players or teams alternatingly playing flat game pieces upon the playing surface in a side edge to side edge abutting fashion. The game is won by either "flowering," which is surrounding a scoring piece with playing pieces in a particular pattern, or by having the highest score at the end of play if no player "flowers." In the preferred embodiment, the game has ninety playing pieces and eighteen scoring pieces. In this arrangement, a maximum of three players or three teams of players can play the game at one time. Inclusion of more playing pieces and more scoring pieces in order for more players or teams of players to play is also envisioned. The ninety playing pieces are divided into three equal groups of thirty pieces. All of the pieces within a group are like colored, each of a color selected from a set of three colors. The pieces of different groups could be differentiated by markings, symbols, or letters, but differentiation by colors is the preferred embodiment of the game. For instance, one of the groups could be colored black, one of the groups colored red and one of the groups colored white, as shown in FIGS. 2A, 2B, 3A, 3B, 4A and 4B. FIG. 2A shows a red playing piece 12, this view showing the obverse side 13 of playing piece. The reverse side 3 of the playing piece, as shown in FIG. 2B, is likewise colored. FIG. 3A shows the obverse side 15 of a black playing piece 14. FIG. 3B shows the reverse side 5 of the playing piece shown in FIG. 3A. FIG. 4A shows the obverse side 17 of a white playing piece 16, and FIG. 4B shows the reverse 7 side of the same piece. While black, red and white are shown as the preferred colored combinations, any color combinations can be used. In one version of the game, each team is given one of these three groups of playing pieces. In the preferred embodiment, the playing pieces are available and visible to all teams or players.

Figure 5A:
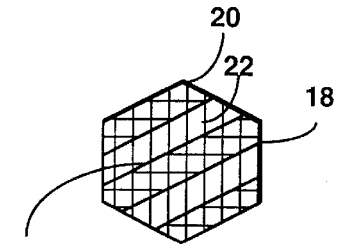
FIG. 5A shows the obverse view a first color scoring piece.
Figure 6A:
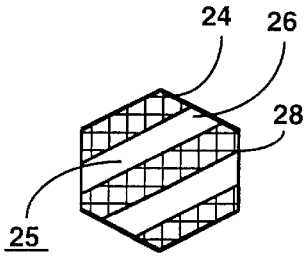
FIG. 6A shows the obverse view a second color scoring piece.
Figure 7A:
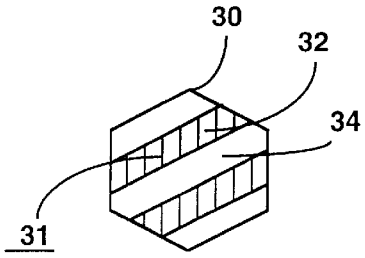
FIG. 7A shows the obverse view a third color scoring piece.
Figure 5B:
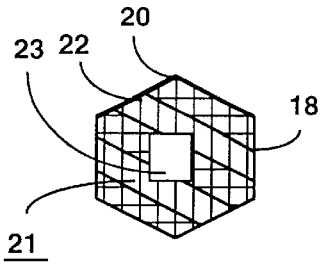
FIG. 5B shows the reverse view of a first color scoring piece.
Figure 6B:
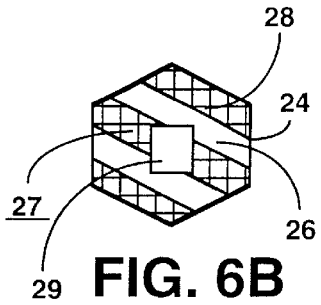
FIG. 6B shows the reverse view of a second color scoring piece
Figure 7B:
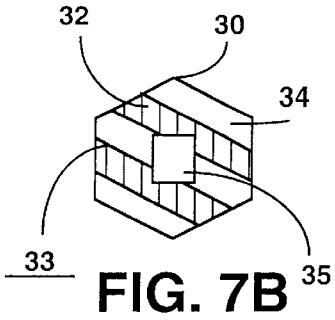
FIG. 7B shows the reverse view of a third color scoring piece.

The 18 scoring pieces are comprised of three separate, distinguishable groups as well. Solid colors may be used as in the playing pieces. However, it is preferred that a pattern be used to help distinguish between scoring and playing pieces. In a preferred embodiment, there are six black and white patterns of scoring pieces, six red and white patterns and six red and black patterns. FIG. 5A shows the obverse side 19 of a red and black scoring piece 18, this piece having red portions 20 and black portions 22. FIG. 5B shows the reverse side 21 of the piece shown in FIG. 5A, this reverse side 21 having red portions 20 and black portions 22, and optionally having a distinctive marking 23. FIG. 6A shows the obverse side 25 of a black and white scoring piece 24, this scoring piece having white portions 26 and black portions 28. FIG. 6B shows the reverse side 27 of the piece shown in FIG. 6A, this scoring piece having white portions 26 and black portions 28 as well, and also optionally having a distinctive marking 29. FIG. 7A shows the obverse side 31 of a white and red scoring piece 30, having red portions 32 and white portions 34. FIG. 7B shows the reverse side 33 of the piece shown in FIG. 7A, this piece having red sections 32 and white sections 34, this piece also optionally having a distinctive marking 35. As with the playing pieces, the scoring pieces may be any color or marking so long as they can be differentiated.

The playing and scoring pieces may be manufactured in plastic, plaster, ceramic, glass, metal, stone, wood or any other material that may be manufactured or crafted. The preferred playing pieces and scoring pieces are regular hexagonal shaped tiles, however any polygon, both regular or irregular, may be used.

The game may be played upon any flat surface 40 agreed upon by the players. The flat surface may be a computer screen if the game is embodied in a computer game version. The only limitation on playing on a surface is that the edge of the surface 40 becomes a border for the game. For instance, if the game is played on a table, the edge of the table becomes the limit of play in that given direction.

While this game may be played by individuals or by teams, where the description of the preferred embodiment refers to "teams," said usage of "teams" is to include individual players if team play is not being used. The following description of how the game is played is its preferred version, and other versions are possible.

The game is played by each team (or individual) choosing a group of scoring pieces. These scoring pieces will be solely that team's to play during the game. The playing pieces may be divided between teams, or may be available as a group to any player or team. The preferred method is for the playing pieces to be available to any team or player. Determination of which team will play the first piece of the game will be done either by lot or agreement. Play is begun by the placement of a playing piece by a team on the playing surface. After the team has placed its playing piece, then the next team will play a playing piece, and in the preferred embodiment of the game, may also play a scoring piece.

Determination of playing order can be determined by lots, by agreement, or in default in a clockwise direction. The playing or scoring piece played by a team (except when playing "up," as discussed infra), must be played in a side-by-side arrangement with a playing or scoring piece that has already been played, as shown in the Figures. After the first move of the game (which must be a playing piece), the team playing a piece must play a playing piece and may also play a scoring piece during its turn. Once a playing or scoring piece has been placed on the playing surface in a proper position, and the hand of the player removed, it is considered played. Pieces are played by the teams until one of the following happens:

1. A team flowers, thus winning the game;
2. All of the playing pieces have been played; or
3. All the scoring pieces have been played.

Figure 8:
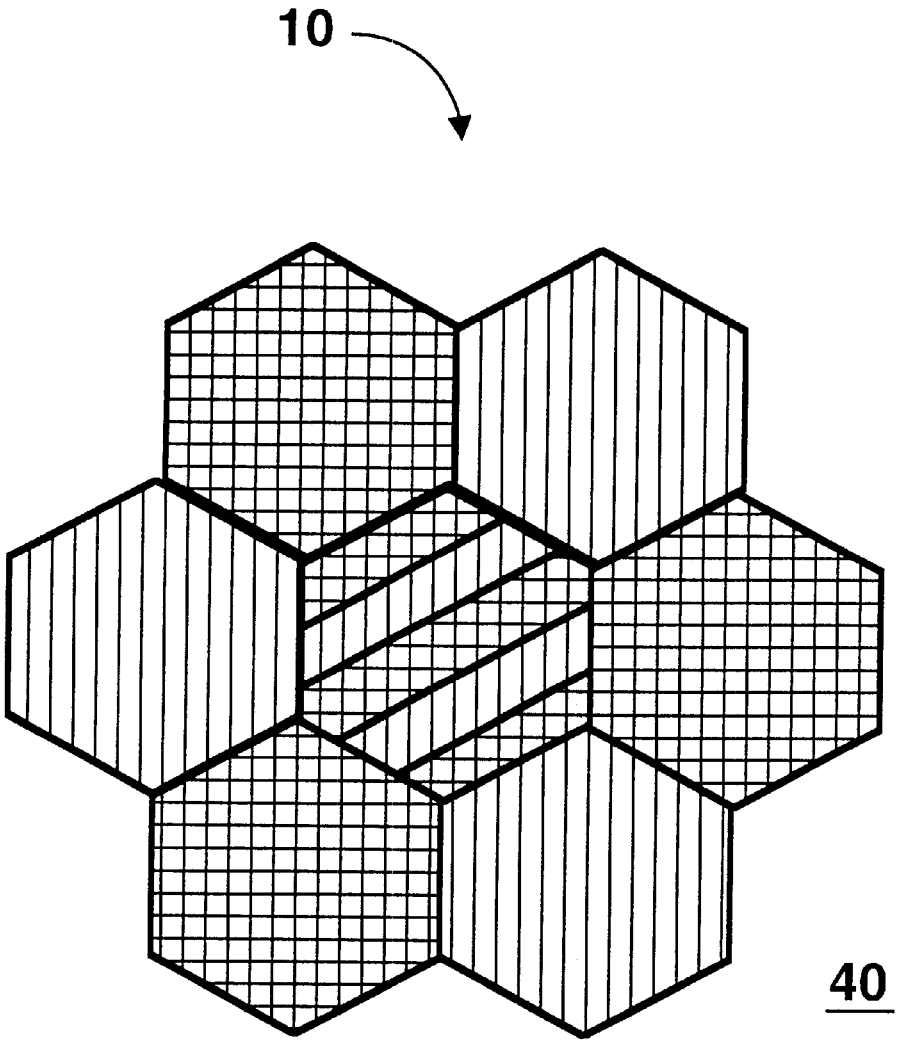
FIG. 8 shows one embodiment of the game apparatus, showing the "flower" arrangement.

A team "flowers" when it creates an alternating pattern in the same colors as its scoring pieces around one of its scoring pieces, as shown in FIG. 8. Upon "flowering" the team instantly wins the game.

Scoring pieces may be played in one of two manners. First, a scoring piece may be played upon the playing surface at the same level as the playing pieces. This is referred to as the "down" position. Scoring pieces may also be played in an "up" position. The up position involves the playing of a scoring piece upon the top of another playing piece that has been previously played. However, a scoring piece may not be played on top of another scoring piece.

If during a game, neither team has "flowered," then at the end of play the team with the highest score wins. A team receives points for the creation of "runs" surrounding its scoring pieces. A run is an alternating pattern of playing pieces in the colors of a team's scoring piece arranged around the scoring piece. There may be more than one run around a scoring piece. Essentially, a run is an incomplete flower. Runs are scored as follows:

| Number of Playing Pieces in Run | Scoring Piece Played "Up" | Scoring Piece Played "Down" |
|---|---|---|
| 2 | 1 point | 1 point |
| 3 | 1 point | 2 points |
| 4 | 2 points | 3 points |
| 5 | 3 points | 5 points |

Figure 9:
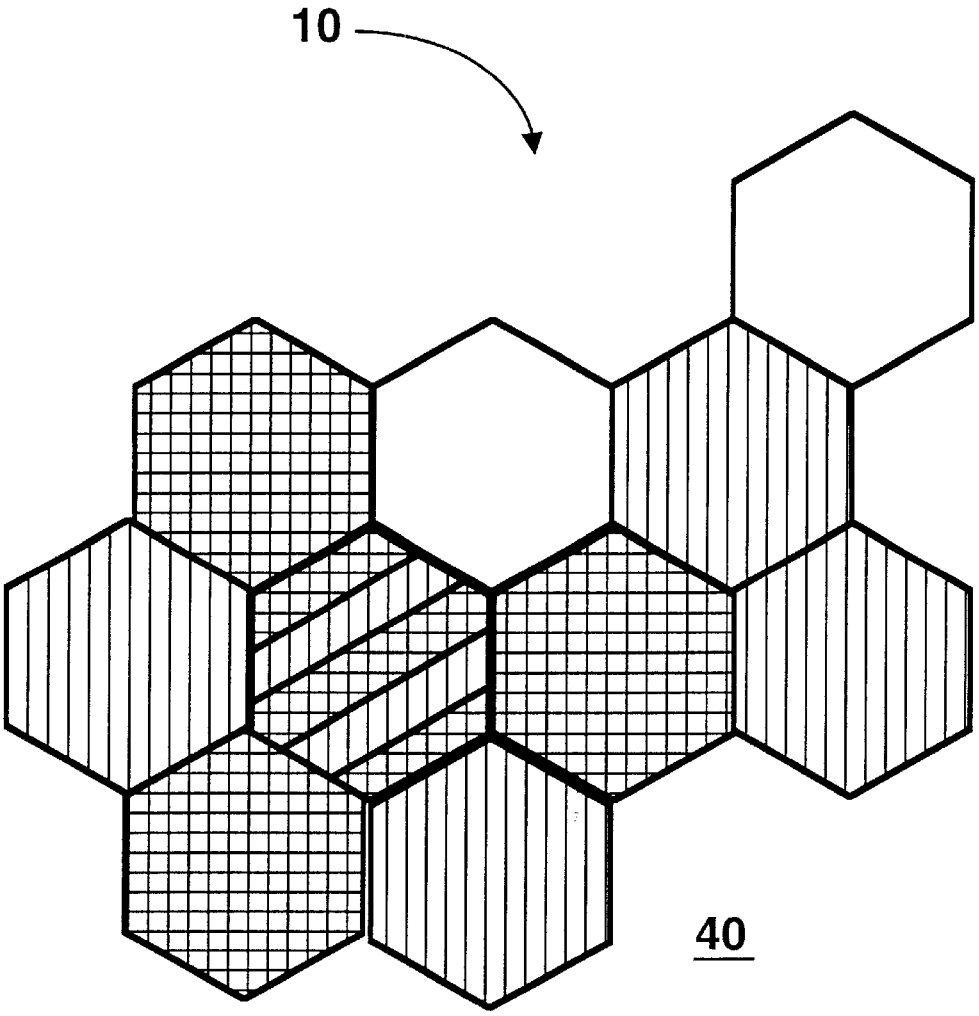
FIG. 9 shows another embodiment of the game apparatus as played showing a "run" of five playing pieces.

This system of scoring rewards a player more for scoring "up" instead or "down". If you score "down" you are telegraphing your intentions, while this is not necessarily the case with scoring "up". The run shown in FIG. 9 would be scored at 3 points if the scoring piece is "up", and at 5 points if the scoring piece is "down".

When playing the two team version of the game, the extra set of scoring pieces may be played by either team. It becomes a common set of scoring pieces. The first team to use any of the extra scoring pieces shall play the scoring piece with the distinctive marking (23, 29, 35) side up while the other team will play any of the extra scoring pieces with the plain side up. This distinguishes which team played which extra scoring piece.

At the end of the game, the score from the runs (in the same colors as the extra piece) on an extra scoring piece is the team who played it and counts toward their total score. It should be noted that a team can win a game by flowering with an extra scoring piece.

There are many different ways to play the game. Other variations include the use of more than three players or teams of players. If there are more than three players, players may be divided into three teams. There may be an uneven number of people on a given team. Each team gets a set of scoring pieces as its own. Play is as in the three player version of the game. Each player of the team takes a turn in rotation making a team's move. For example, if there are three players on a team (Player 1, Player 2, and Player 3), Player 1 would make the first play for the team. As the play rotates around and it is that team's turn again, Player 2 would play for the team and so forth. Part of the play is whether the players of the team may consult with each other during the play period. Another possible alternative way to play the game includes changing the number of playing or scoring pieces. By player agreement there may be more or fewer pieces of each color for the purpose of extending play, giving one player better odds, etc. The number of scoring pieces may also be adjusted up or down, by player agreement, just as the playing pieces may be adjusted.

Alternate methods for ending the game include ending play when one team has played all its scoring pieces even though other teams may still have scoring pieces that are unplayed. This also applies to played/unplayed extra scoring pieces in the two team version of the game.

Other alternative rules to the game include the time between the moves may be timed with a limited time to finish the game. Time limits are to be agreed upon by the teams; a different method of counting score on runs may be agreed upon and used to determine the order of the game; and/or instead of a team picking the color of the playing piece to be played by it on its turn of play, it can be (a) be picked at random using a die or other method, (b) be picked for it by the last team to play, (c) be picked by the next team after the current team, or (d) be picked by some other method agreed upon by the teams before play begins.

While there is shown and described the present preferred embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

We claim:

1. A game for use by two or more players, comprising:

a plurality of flat, polygonal playing pieces, which have edges, with said polygonal playing pieces marked to form at least three groups of polygonal playing pieces; and a plurality of flat, polygonal scoring pieces, which have edges, with said polygonal scoring pieces marked to form at least three groups of polygonal scoring pieces;

wherein said game is played by players alternately placing said polygonal playing pieces on a flat playing surface edge to edge, so that said scoring pieces are surrounded or partially surrounded by playing pieces which are of a marking contained in said scoring piece, and in which points are scored by surrounding a scoring piece with playing pieces, and forming runs of playing pieces adjacent a scoring piece, in which said playing pieces are of markings contained in said scoring piece and adjacent playing pieces in a run are of alternating markings.

2. The game of claim 1 in which said polygonal playing pieces and said polygonal scoring pieces are marked to form groups using different colors.

3. The game of claim 1 in which said polygonal playing pieces and said polygonal scoring pieces are marked to form groups using different symbol markings.

4. The game of claim 1 in which said polygonal playing pieces and said polygonal scoring pieces are marked to form groups using different letters.

5. The game of claim 1 which is won by a player completely surrounding a scoring piece with playing pieces in which the playing pieces have colors contained in said scoring piece, and are arranged in an alternating color configuration.

6. A game for use by two or more players, comprising:

a plurality of flat, colored hexagonal playing pieces, which have edges, with said color selected from a set of three colors;

a plurality of flat, hexagonal scoring pieces, which have edges, with said colors selected from said set of three colors; and a flat playing surface;

wherein said game is played by players alternately placing said hexagonal playing pieces on a flat playing surface edge to edge, so that scoring takes place when said scoring pieces are surrounded or partially surrounded by playing pieces which are of a color contained in said scoring piece, and in which points are scored by runs of playing pieces adjacent a scoring piece, in which said playing pieces are of colors contained in said scoring piece and adjacent playing pieces in a run are of alternating colors.

7. The game of claim 6 in which said game is won by a player completely surrounding a scoring piece with playing pieces in which said playing pieces are of colors contained in said scoring piece, are arranged in an alternating color configuration, and which are placed edge to edge to said scoring piece.

8. The game of claim 7 in which scoring pieces may be played by placement on top of a playing piece which has been played previously.

9. The game of claim 8 in which said scoring pieces may be marked differently on each side.

10. A game for use by two or more players, comprising:

a plurality of flat, colored hexagonal playing pieces, which have edges, with said color selected from a set of three colors; and a plurality of flat, hexagonal scoring pieces, which have edges, with said colors selected from said set of three colors;

wherein said game is played by players alternately placing said hexagonal playing pieces on a flat playing surface edge to edge, so that said scoring pieces are surrounded or partially surrounded by playing pieces which are of a color contained in said scoring piece, and in which points are scored by surrounding a scoring piece with playing pieces and by creating runs of playing pieces adjacent a scoring piece, in which said playing pieces are of colors contained in said scoring piece and adjacent playing pieces in a run are of alternating colors and in which said game is won by a player completely surrounding a scoring piece with playing pieces in which said playing pieces are of colors contained in said scoring piece, are arranged in an alternating color configuration, and which are placed edge to edge to said scoring piece, and in which said scoring pieces may be played by placement on top of a playing piece which has been played previously, and in which said scoring pieces may be marked differently on each side.

11. A method of playing a game with multiple players which comprises the steps of:

assigning to each player two sets of polygonal playing pieces, each set being of a different color and chosen from a group of more than three colors;

assigning to each player a set of scoring pieces, said scoring pieces being bi-colored on each surface;

providing a flat playing surface for the placement of playing or scoring pieces by said players;

selecting a first player;

playing of a playing piece on said flat playing surface by said first player;

playing of playing pieces and scoring pieces by players, so that said pieces are adjacent to pieces which have already been played;

continuing play until each player has played all his playing and scoring pieces; and scoring said game by assigning points for playing pieces surrounding scoring pieces, in which the surrounding playing pieces are of alternating colors, and are of one of the colors of the scoring piece.

12. The method of claim 11 which further includes the step of ending the game when a player completely surrounds a scoring piece with playing pieces, in which the surrounding playing pieces are of alternating colors, and of the same colors as the colors of the scoring piece.

13. A method of playing a game with multiple players which comprises the steps of:

assigning to each player two sets of hexagonal playing pieces, each set being of a different color and chosen from a group of three colors;

assigning to each player a set of scoring pieces, said scoring pieces being bi-colored on each surface;

providing a flat playing surface for the placement of playing or scoring pieces by said players;

selecting a first player;

playing of a playing piece on said flat playing surface by said first player;

playing of playing pieces and scoring pieces by players, so that said pieces are adjacent to pieces which have already been played;

continuing play until each player has played all his playing and scoring pieces; and scoring said game by assigning points for playing pieces surrounding scoring pieces, in which the surrounding playing pieces are of alternating colors, and are of one of the colors as the colors of the scoring piece.

14. The method of claim 13 which further includes the step of ending the game when a player completely surrounds a scoring piece with playing pieces, in which the surrounding playing pieces are of alternating colors, and of the same colors as the colors of the scoring piece.

15. The method of claim 14 in which said scoring pieces may be marked differently on each side.

16. The method of claim 13 which further includes the step of playing pieces by superimposing placement on a previously played piece.

17. A method of playing a game with multiple players which comprises the steps of:

assigning to each player two sets of polygonal playing pieces, each set being of a different color and chosen from a group of more than three colors;

assigning to each player a set of scoring pieces, said scoring pieces being bi-colored on each side;

providing a flat playing surface for the placement of playing or scoring pieces by said players;

selecting a first player;

playing of a playing piece on said flat playing surface by said first player;

playing of playing pieces and scoring pieces by players, so that said pieces are adjacent to pieces which have already been played;

continuing play until each player has played all his playing and scoring pieces;

scoring said game by assigning points for playing pieces surrounding scoring pieces, in which the surrounding playing pieces are of alternating colors, and are of one of the colors of the scoring piece; and ending the game when a player completely surrounds a scoring piece with playing pieces, in which the surrounding playing pieces are of alternating colors, and of the same colors as the colors of the scoring piece.

18. A method of playing a game with multiple players which comprises the steps of:

assigning to each player two sets of hexagonal playing pieces, each set being of a different color and chosen from a group of three colors;

assigning to each player a set of scoring pieces, said scoring pieces being bi-colored on each side;

providing a flat playing surface for the placement of playing or scoring pieces by said players;

selecting a first player;

playing of a playing piece on said flat playing surface by said first player;

playing of playing pieces and scoring pieces by players, so that said pieces are adjacent to pieces which have already been played;

continuing play until each player has played all his playing and scoring pieces;

scoring said game by assigning points for playing pieces surrounding scoring pieces, in which the surrounding playing pieces are of alternating colors, and are of one of the colors as the colors of the scoring piece; and ending the game when a player completely surrounds a scoring piece with playing pieces, in which the surrounding playing pieces are of alternating colors, and of the same colors as the colors of the scoring piece.

19. A method of playing a game with multiple players which comprises the steps of:

assigning to each player two sets of hexagonal playing pieces, each set being of a different color and chosen from a group of three colors;

assigning to each player a set of scoring pieces, said scoring pieces being bi-colored on each side;

providing a flat playing surface for the placement of playing or scoring pieces by said players;

selecting a first player;

playing of a playing piece on said flat playing surface by said first player;

playing of playing pieces and scoring pieces by players, so that said pieces are adjacent to pieces which have already been played;

continuing play until each player has played all his playing and scoring pieces;

scoring said game by assigning points for playing pieces surrounding scoring pieces, in which the surrounding playing pieces are of alternating colors, and are of one of the colors as the colors of the scoring piece; and playing pieces by superimposing placement on a previously played piece.

20. A method of playing a game with multiple players which comprises the steps of:

assigning to each player two sets of hexagonal playing pieces, each set being of a different color and chosen from a group of three colors;

assigning to each player a set of scoring pieces, said scoring pieces being bi-colored and marked differently on each side;

providing a flat playing surface for the placement of playing or scoring pieces by said players;

selecting a first player;

playing of a playing piece on said flat playing surface by said first player;

playing of playing pieces and scoring pieces by players, so that said pieces are adjacent to pieces which have already been played;

continuing play until each player has played all his playing and scoring pieces; and scoring said game by assigning points for playing pieces surrounding scoring pieces, in which the surrounding playing pieces are of alternating colors, and are of one of the colors as the colors of the scoring piece.

* * * * *